US008942586B2

(12) United States Patent
Tanaka et al.

(10) Patent No.: US 8,942,586 B2
(45) Date of Patent: Jan. 27, 2015

(54) IMAGE FORMING APPARATUS USING A PLURALITY OF TONER PATCHES DURING A NON-PRINTING PERIOD

(71) Applicants: Kayoko Tanaka, Tokyo (JP); Kohta Fujimori, Kanagawa (JP); Keita Sone, Kanagawa (JP)

(72) Inventors: Kayoko Tanaka, Tokyo (JP); Kohta Fujimori, Kanagawa (JP); Keita Sone, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 71 days.

(21) Appl. No.: 13/790,672

(22) Filed: Mar. 8, 2013

(65) Prior Publication Data

US 2013/0236200 A1 Sep. 12, 2013

(30) Foreign Application Priority Data

Mar. 12, 2012 (JP) ..... 2012-054319
Jan. 4, 2013 (JP) ..... 2013-000085

(51) Int. Cl.
*G03G 15/00* (2006.01)
*G03G 15/08* (2006.01)
*G03G 15/01* (2006.01)

(52) U.S. Cl.
CPC ..... *G03G 15/0824* (2013.01); *G03G 15/0189* (2013.01); *G03G 15/5058* (2013.01); *G03G 2215/0158* (2013.01)
USPC ..... 399/49

(58) Field of Classification Search
USPC ..... 399/49
See application file for complete search history.

(56) References Cited

U.S. PATENT DOCUMENTS

| | | | | |
|---|---|---|---|---|
| 5,860,038 | A | 1/1999 | Kato et al. | |
| 6,160,569 | A | 12/2000 | Fujimori et al. | |
| 6,553,191 | B1 * | 4/2003 | Nakane | |
| 7,486,414 | B2 * | 2/2009 | Arai | 358/1.9 |
| 7,995,240 | B2 * | 8/2011 | Ikeno et al. | 358/1.9 |
| 8,116,646 | B2 * | 2/2012 | Akiyama | 399/49 |
| 2002/0089579 | A1 | 7/2002 | Yamanaka et al. | |
| 2004/0119805 | A1 | 6/2004 | Yamanaka et al. | |
| 2005/0185206 | A1 | 8/2005 | Yamanaka et al. | |
| 2006/0233561 | A1 | 10/2006 | Yamaoka | |
| 2007/0025748 | A1 | 2/2007 | Ishibashi et al. | |
| 2007/0230979 | A1 | 10/2007 | Hasegawa et al. | |

(Continued)

FOREIGN PATENT DOCUMENTS

| | | |
|---|---|---|
| JP | 2002-207337 | 7/2002 |
| JP | 2006-293240 | 10/2006 |

(Continued)

*Primary Examiner* — Sandra Brase
(74) *Attorney, Agent, or Firm* — Oblon, Spivak, McClelland, Maier & Neustadt, L.L.P.

(57) ABSTRACT

An image forming apparatus includes a controller configured to control a toner-image forming device to form a toner patch; and a detector configured to detect the toner patch on the image carrier. During a non-printing period, the controller causes a toner-image forming device to form toner patches, causes the detector to detect densities of the toner patches, and adjusts an image-forming condition of the toner-image forming device based on detected densities. During a printing period, the controller causes the toner-image forming device to form an output image in an image area and form fewer toner patches in a non-image area, causes the detector to detect densities of the fewer toner patches, and adjusts the image-forming condition of the toner-image forming device based on detected densities. The fewer toner patches are selected from and fewer than the plurality of toner patches formed during the non-printing period.

11 Claims, 14 Drawing Sheets

(56) References Cited

U.S. PATENT DOCUMENTS

| | | | |
|---|---|---|---|
| 2008/0145078 | A1 | 6/2008 | Tomita et al. |
| 2008/0310867 | A1 | 12/2008 | Yamanaka et al. |
| 2009/0116855 | A1 | 5/2009 | Yamanaka et al. |
| 2009/0324267 | A1 | 12/2009 | Yoshida et al. |
| 2010/0067937 | A1 | 3/2010 | Yamanaka et al. |
| 2012/0294637 | A1 | 11/2012 | Tanaka et al. |

FOREIGN PATENT DOCUMENTS

| | | |
|---|---|---|
| JP | 2008-151896 | 7/2008 |
| JP | 2010-015110 | 1/2010 |

* cited by examiner

IMAGE FORMING APPARATUS USING A PLURALITY OF TONER PATCHES DURING A NON-PRINTING PERIOD

CROSS-REFERENCE TO RELATED APPLICATIONS

The present application claims priority to and incorporates by reference the entire contents of Japanese Patent Application No. 2012-054319 filed in Japan on Mar. 12, 2012 and Japanese Patent Application No. 2013-000085 filed in Japan on Jan. 4, 2013.

BACKGROUND OF THE INVENTION

1. Field of the Invention

The present invention relates to an image forming apparatus.

2. Description of the Related Art

Techniques adopted by image forming apparatuses, such as printers, facsimiles, and copiers, for reducing density variations and correct color misregistration caused by a lapse of time and environmental change include a technique of forming test toner patches on a transfer belt and detecting densities and positions of the patches.

Japanese Patent Application Laid-open No. 2002-207337 discloses such a technique for bringing yellow, magenta, cyan, and black toner images in registration by forming a plurality of toner patches for use in correcting color misregistration on a transfer belt every time the number of output sheets reaches a predetermined number at power-on or the like.

There is also known a similar technique for performing density adjustment on toner-image forming devices, each of which forms a toner image of one color, in a full-color image forming apparatus.

Japanese Patent Application Laid-open No. 2006-293240 discloses a technique for performing density correction by forming toner patches in a non-image frame during a period when a to-be-output image (hereinafter, "output image") is formed.

A large number of currently-used full-color image forming apparatus adopts such a technique as that disclosed in Japanese Patent Application Laid-open No. 2002-207337 for reducing density variations and correcting misregistration by (i) disabling image-output processing every time the number of output sheets reaches a predetermined number, (ii) forming a plurality of toner patches on a transfer belt, and (iii) detecting densities and positions of the toner patches.

However, the technique described above is disadvantageous in that the process of forming the plurality of toner patches in every corresponding color and detecting the patches is time consuming, and an image cannot be output during the process. As a scheme for resolving this problem, lengthening time intervals between corrective detections is conceivable. However, this scheme can disadvantageously make image density less stable or cause color misregistration to be likely to occur.

The technique disclosed in Japanese Patent Application Laid-open No. 2006-293240 does not involve such a period as that described above during which image output is disabled because the toner patches are formed concurrently with image-output processing. However, because the toner patches are formed outside an image area, the number of patches that can be formed is limited; accordingly, control becomes less accurate. Thus, this technique is not satisfactorily appropriate for full-color image forming apparatuses for which tone stability is of primary importance for the sake of printing photographic images and the like.

Therefore, there is a need for an image forming apparatus capable of stabilizing image densities and reducing color misregistration without downtime.

SUMMARY OF THE INVENTION

It is an object of the present invention to at least partially solve the problems in the conventional technology.

According to an embodiment, there is provided an image forming apparatus that includes an image carrier; a toner-image forming device configured to form a toner image on the image carrier; a controller configured to control the toner-image forming device to form a toner patch; a detector configured to detect the toner patch on the image carrier; and a developing unit including a developing roller. During a non-printing period, the controller causes the toner-image forming device to form a plurality of toner patches, causes the detector to detect densities of the plurality of toner patches, and adjusts an image-forming condition of the toner-image forming device based on detected densities. During a printing period, the controller causes the toner-image forming device to form an output image in an image area and form fewer toner patches in a non-image area, causes the detector to detect densities of the fewer toner patches, and adjusts the image-forming condition of the toner-image forming device based on detected densities, the fewer toner patches being selected from and fewer than the plurality of toner patches formed during the non-printing period.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the invention is described below with reference to the accompanying drawings.

Figure 1:
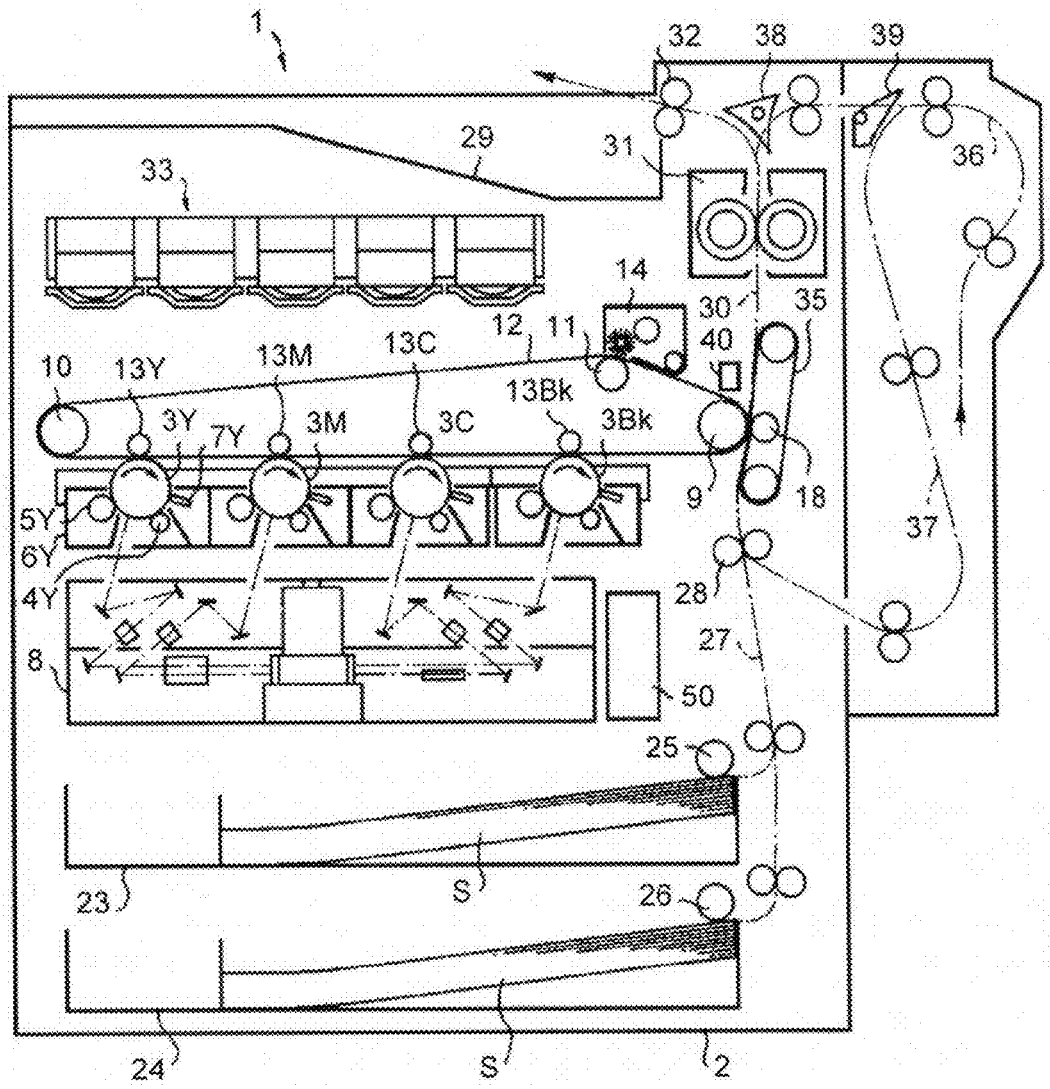
FIG. 1 is a cross-sectional configuration diagram of a full-color printer, which is an example of an image forming apparatus according to an embodiment of the present invention.

FIG. 1 is a cross-sectional configuration diagram of a full-color printer, which is an example of an image forming apparatus according to an embodiment of the present invention. A full-color printer 1 illustrated in FIG. 1 includes four photosensitive elements in a substantially center portion of an apparatus body 2. The photosensitive elements 3Y, 3M, 3C, and 3Bk are arranged equidistant in the lateral direction in FIG. 1 and horizontally laid to be parallel to one another. Note that Y, M, C, and Bk are suffixes representing colors yellow, magenta, cyan, and black, respectively, and the suffix is omitted as appropriate. The photosensitive elements 3 are described by way of example of the photosensitive element 3Y for a yellow image. The photosensitive element 3Y is an aluminum cylinder that is approximately 30 to 100 millimeters in diameter with an organic semiconductor layer having photoconductivity formed on surface of the cylinder, for example. The photosensitive element 3Y is rotated clockwise (the direction indicated by arrow in FIG. 1) in FIG. 1. Image forming elements including a developing unit 6Y that includes an electrostatic charging roller 4Y and a developing roller 5Y, and a cleaning member 7Y are arranged in a manner to surround a lower half of the photosensitive element 3Y according to an electrophotographic process procedure. The same goes for each of the photosensitive elements 3M, 3C, and 3Bk. In other words, the photosensitive elements 3 differ from one another only in color of toner to be used. Belt-type photosensitive elements can alternatively be used.

An exposure unit 8 is arranged below the photosensitive elements 3Y, 3M, 3C, and 3Bk, the electrostatic charging rollers 4, the developing units 6, and the cleaning members 7. The exposure unit 8 forms electrostatic latent images by scanning each of the uniformly-electrostatically-charged photosensitive elements 3Y, 3M, 3C, and 3Bk with laser light according to image data for corresponding one of the colors. Provided between the respective electrostatic charging rollers 4 and the respective developing rollers 5 are elongated spaces (slits) that allow the laser light emitted from the exposure unit 8 to pass therethrough toward the photosensitive elements 3Y, 3M, 3C, and 3Bk. The exposure unit 8 illustrated in FIG. 1 is of a laser-scan type that uses a laser light source and a polygon mirror. Alternatively, an exposure unit that uses a combination of a light-emitting diode (LED) array and an image forming unit can be employed.

An intermediate transfer belt 12 that is supported by a plurality of rollers 9, 10, and 11 and to be rotated counter-clockwise is arranged on tops of the photosensitive elements 3Y, 3M, 3C, and 3Bk. The intermediate transfer belt 12 is shared by the photosensitive elements 3Y, 3M, 3C, and 3Bk. The intermediate transfer belt 12 is arranged approximately horizontally and flat so that a portion of each of the photosensitive elements 3Y, 3M, 3C, and 3Bk comes into contact with the intermediate transfer belt 12 after a developing process. Transfer rollers 13Y, 13M, 13C, and 13Bk are arranged on an inner periphery of the belt so as to face the photosensitive elements 3Y, 3M, 3C, and 3Bk, respectively. A cleaning device 14 is arranged on an outer periphery of the intermediate transfer belt 12 at a position, for instance, where the cleaning device 14 faces the roller 11. The cleaning device 14 removes unnecessary toner left on a surface of the belt. The intermediate transfer belt 12 can be, for example, a belt of which substrate is a plastic film or rubber that is 50 to 600 μm thick and having a resistance that allows transferring toner images on the photosensitive elements 3Y, 3M, 3C, and 3Bk via the belt. A toner-image forming device including the photosensitive element 3, the electrostatic charging roller 4, the developing unit 6, the cleaning member 7, and the exposure unit 8 forms a toner image on the intermediate transfer belt 12, which is an image carrier. The toner image is transferred via the transfer roller 13 onto the intermediate transfer belt 12.

A plurality of paper cassettes (two paper cassettes, which are paper cassettes 23 and 24, in the present embodiment) arranged in the apparatus body 2 at a position below the exposure unit 8. The paper cassettes 23 and 24 can be pulled out to be dismounted from the apparatus body 2 as appropriate. The paper cassettes 23 and 24 hold therein sheets S of recording medium. Each of the sheets S is selectively fed by one of sheet feeding rollers 25 and 26, which are for the paper cassettes 23 and 24, respectively. A sheet-feed conveying path 27 is formed approximately vertically to convey the sheet S toward a transfer position. A conveying belt 35 is laterally adjacent to the intermediate transfer belt 12. A secondary transfer roller 18, which is a secondary transfer unit, is arranged inside a loop of the conveying belt 35 in a manner to face the roller 9, which is one of the rollers supporting the intermediate transfer belt 12. The roller 9 and the transfer roller 18 are brought into pressure contact with each other with the intermediate transfer belt 12 and the conveying belt 35 therebetween. A pair of registration rollers 28 for feeding the sheet S to the transfer position at appropriate timing is arranged on the sheet-feed conveying path 27 at a position immediately upstream of the transfer position. A sheet-output conveying path 30 is arranged above the transfer position. The sheet-output conveying path 30 extends from the sheet-feed conveying path 27 to be connected to a discharged sheet stacker 29 on a top of the apparatus body 2. A fixing unit 31 including a pair of fixing rollers and a pair of sheet output rollers 32 are arranged on the sheet-output conveying path 30.

A toner-bin container 33 that stores toner of the respective colors for use by the photosensitive elements 3Y, 3M, 3C, and 3Bk is arranged in the apparatus body 2 in a space below the discharged sheet stacker 29. The toner-bin container 33 is capable of supplying the toner of each color to the corresponding developing unit 6 using a pump or the like.

Operations performed by the image forming apparatus 1 configured as described above to form an image on the sheet S are described below.

An image signal representing an output image is transmitted from a personal computer (PC), a scanner, a facsimile or the like to a controller 50. The controller 50 converts the image signal to an appropriate output image signal determined by control operations, which will be described later, and transmits the converted image signal to the exposure unit 8. In the exposure unit 8, a semiconductor laser emits laser light according to image data for yellow to the surface of the photosensitive element 3Y that is uniformly charged by the electrostatic charging roller 4Y. As a result, an electrostatic latent image is formed on the surface. This electrostatic latent image is subjected to a developing process performed by the developing unit 6Y to be developed into a visible image with yellow toner. The toner image is transferred via the transfer roller 13Y onto the intermediate transfer belt 12 that is rotated in synchronization with the photosensitive element 3Y. The latent-image formation, the development, and the transfer are sequentially performed by the toner-image forming devices each including one of the photosensitive elements 3M, 3C, and 3Bk at appropriate timing. As a result, a yellow toner image, a magenta toner image, a cyan toner image, and a black toner image are sequentially superimposed on one another on the intermediate transfer belt 12, and the thus-formed full-color toner image is carried on and conveyed by the intermediate transfer belt 12.

Meanwhile, the sheet S is fed from any one of the paper cassettes 23 and 24 and conveyed through the sheet-feed conveying path 27 to the registration rollers 28. The sheet S is fed out from the registration rollers 28 at timing synchronized with the full-color toner image on the intermediate transfer belt 12. The full-color toner image on the intermediate transfer belt 12 is transferred to the sheet S via the transfer roller 18. The sheet S onto which the full-color toner image is transferred is conveyed by the conveying belt 35 to the fixing unit 31. The sheet S onto which fixation is performed by the fixing unit 31 is output by the sheet output rollers 32 onto the discharged sheet stacker 29.

When duplex printing is to be performed, the sheet S is turned upside down as follows. A switching claw 38 is operated to guide the sheet S, onto which a toner image is fixed, to a reverse path 36 where the sheet S is turned upside turn. A switching claw 39 is then operated again to feed the turned-upside-down sheet S from a re-feed path 37 to the registration rollers 28. Concurrently therewith, a toner image to be formed on a back side of the sheet S is formed and carried by the intermediate transfer belt 12. The toner image is transferred onto the back side (second surface) of the sheet S and fixed by the fixing unit 31. The sheet S is output by the sheet output rollers 32 onto the discharged sheet stacker 29.

Operations to be performed to form a full-color image are described above, operations for mono-color printing for forming an image of a specific color or black are performed in a similar manner. The mono-color printing differs from full-color printing only in that the mono-color printing is performed without using some of the photosensitive elements.

Figure 2:
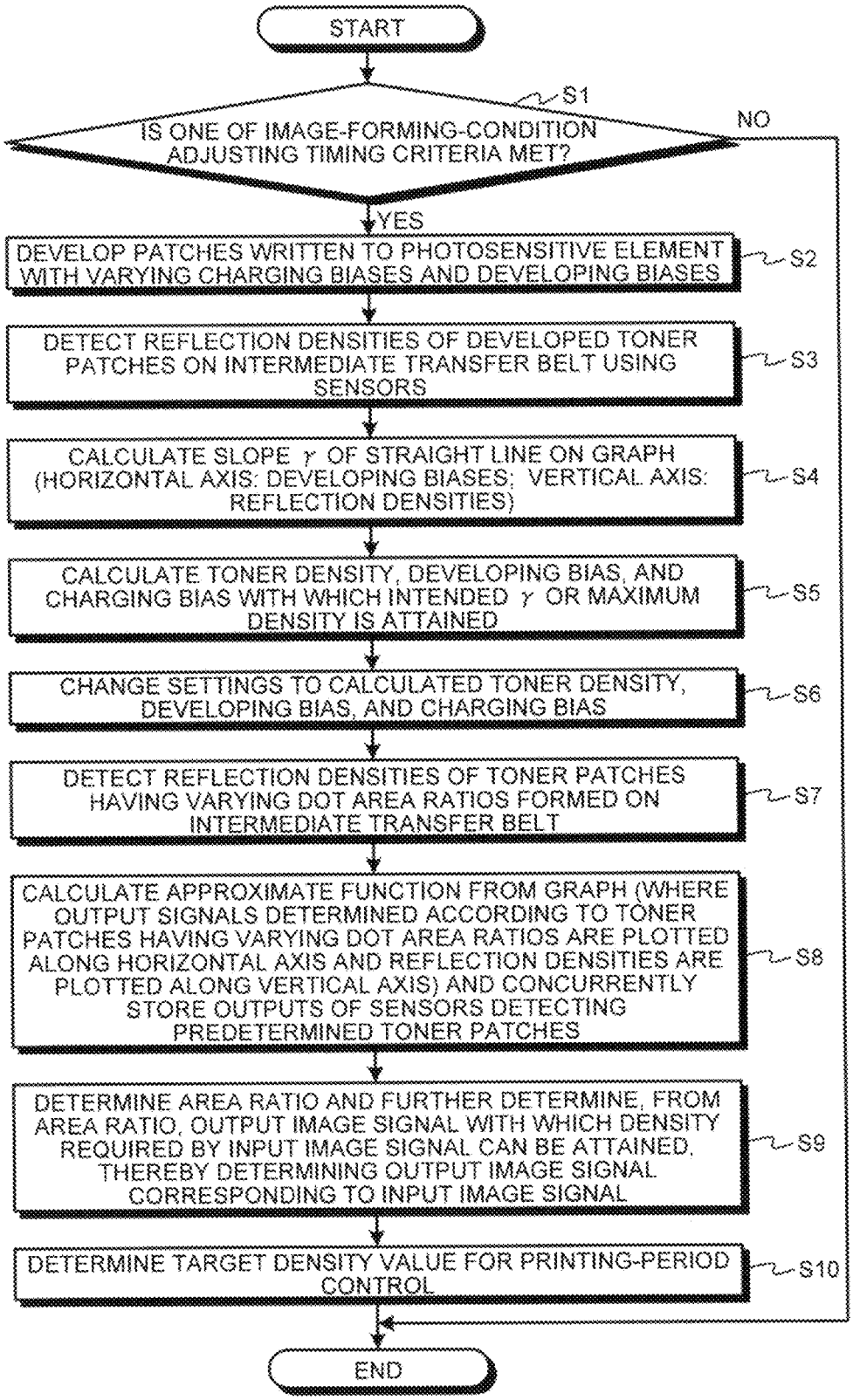
FIG. 2 is a flowchart illustrating example control to be performed during a non-printing period in the image forming apparatus according to the embodiment.

Density control to be performed during a non-printing period (non-printing-period control) is described with reference to FIG. 2.

The "non-printing period" denotes a period during which the image forming apparatus 1 is not performing image-output processing. Examples of the non-printing period include a period in which a start-up operation following power-on is performed and a period in which the photosensitive elements 3 are on idling before or after image-output processing. Generally, even after image density detection and density correction are performed, an image forming apparatus suffers from deviation in image density that occurs over time. In particular, when the temperature and the humidity in the image forming apparatus have changed or the image forming apparatus is unused for a long period, the density is likely to deviate. In addition, as the number of output sheets increases, the density deviates more. In view of such circumstances, image-forming-condition adjusting timing criteria are set to: when the image forming apparatus has printed a predetermined number, which is experimentally determined, of output sheets; when a temperature-humidity sensor provided in the image forming apparatus detects a change equal to or greater than an experimentally-determined threshold value; when the image forming apparatus remains unused longer than an experimentally-determined unused period; and the like. The image-forming-condition adjusting timing criteria are stored in a memory in the controller 50. The controller 50 in the image forming apparatus determines whether any one of such image-forming-condition adjusting timing criteria is met according to internally-stored program instructions (Step S1).

Figure 3:
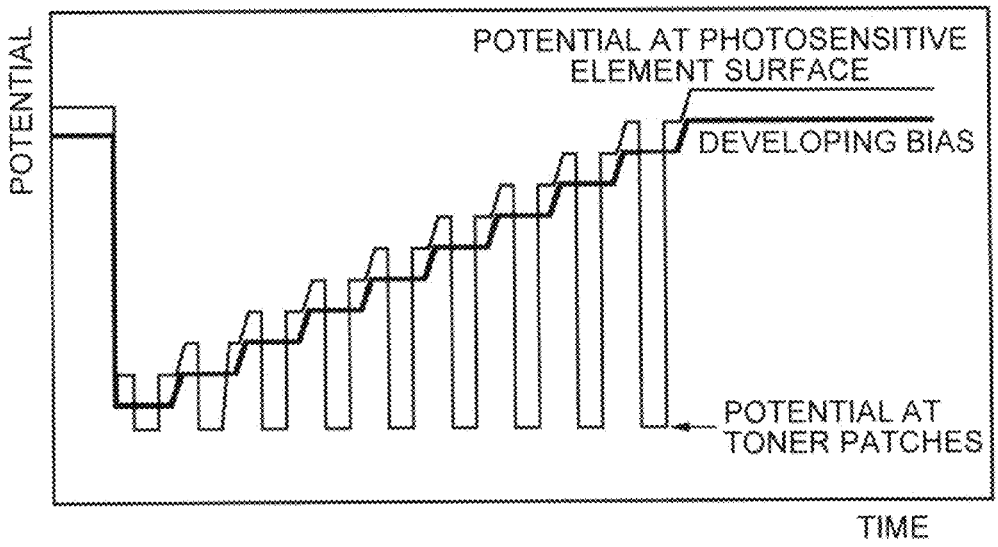
FIG. 3 is a diagram illustrating an example of potentials at toner patches and developing biases applied to form the toner patches during the non-printing period.
Figure 4:
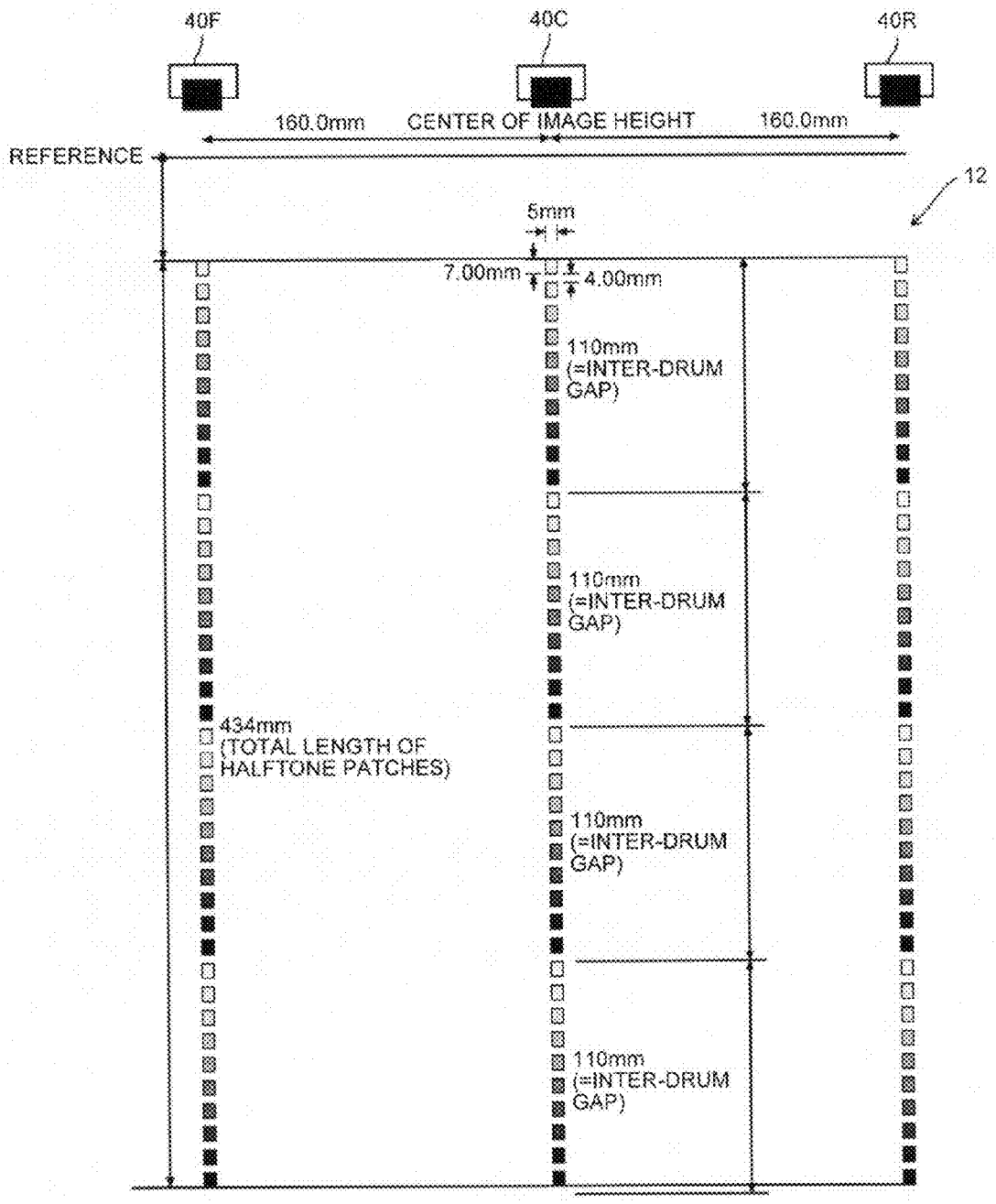
FIG. 4 is a diagram illustrating an example of toner patches formed during the non-printing period by the image forming apparatus according to the embodiment.

When it is determined that one of the image-forming-condition adjusting timing criteria is met (Yes at Step S1), such patches as those illustrated in FIG. 4 are formed on the photosensitive element 3 by causing the developing unit 6 to apply a charging bias and a developing bias that vary as illustrated in FIG. 3 and the exposure unit 8 to perform exposure with continuously emitted laser light. The "exposure with continuously emitted laser light" refers to exposing areas of the patches illustrated in FIG. 4 to continuous laser light rather than exposing the areas in a manner to form the areas with dots. When exposure is performed in this way, the exposed patches on the photosensitive element have approximately equal potential as illustrated in FIG. 3. When the developing bias applied to the patches is varied stepwise as illustrated in FIG. 3, development is performed in such a manner that an amount of toner deposited onto the patches increases in proportion to the difference between the potential at the patch (hereinafter, "patch potential") and the developing bias.

As a result, ten toner patches that vary in density are formed as illustrated in FIG. 4 on each of the photosensitive elements of the respective colors (Step S2 (FIG. 2)). The toner patches are formed in three zones with respect to the direction (hereinafter, "main-scanning direction") in which the photosensitive element 3 is scanned with laser light. The three zones, which are a front (F) zone and a rear (R) zone, and a center (C) zone, correspond to end areas and a center area, respectively, with respect to a direction perpendicular to the direction in which the intermediate transfer belt 12 rotates. In the example illustrated in FIG. 4, black patches, cyan patches, magenta patches, and yellow patches are formed in series in this order from top to bottom in FIG. 4. The smaller the toner patch size, the less toner is consumed. In the present embodiment, each toner patch is rectangular, 5 mm in the main-scanning direction, and 7 mm in the sub-scanning direction along which the intermediate transfer belt 12 rotates and perpendicular to the main-scanning direction. The reason why the developing bias and the charging bias are synchronously changed is that when the difference between the developing bias and the charging bias is excessively large, a problem such as carrier adhesion onto the photosensitive element 3 can occur in a two-component developing unit.

The toner patches formed on the photosensitive elements 3 are transferred via the transfer roller 13 (e.g., transfer rollers 13Y, 13M, 13C, and/or 13Bk) onto the intermediate transfer belt 12. As a result, ten toner patches for each color are formed in each of the three zones, which are the front (F) zone, the rear (R) zone, and the center (C) zone, on the intermediate transfer belt 12 as illustrated in FIG. 4. Subsequently, sensors 40F, 40C, and 40R, which are detectors, detect reflection densities of the toner patches (Step S3 (FIG. 2)).

Figure 5:
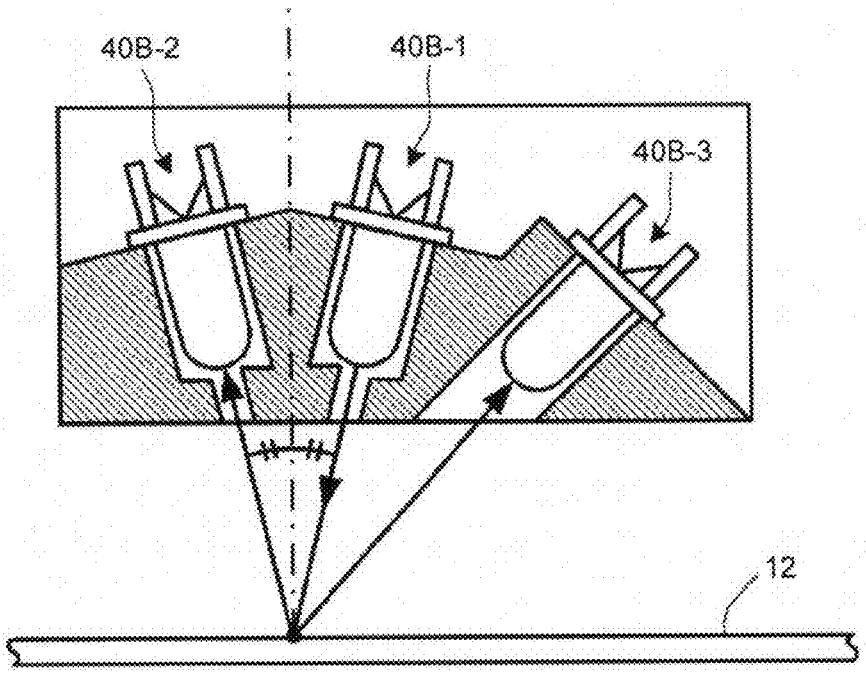
FIG. 5 is a diagram of a light reflection density sensor, which is an example of a detector for detecting toner patches.
Figure 6:
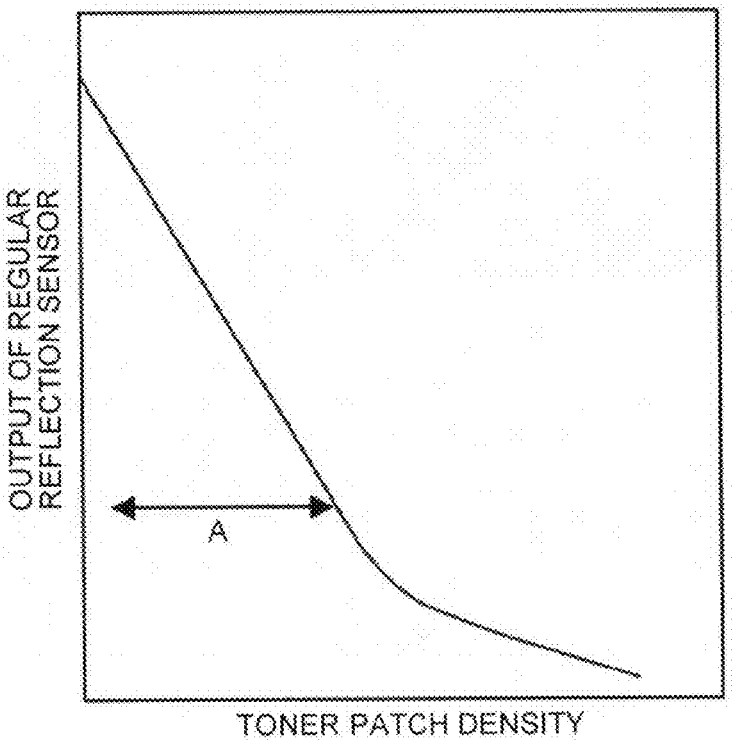
FIG. 6 is a diagram illustrating an example of outputs of a regular-reflection-light density sensor detecting black toner.
Figure 7:
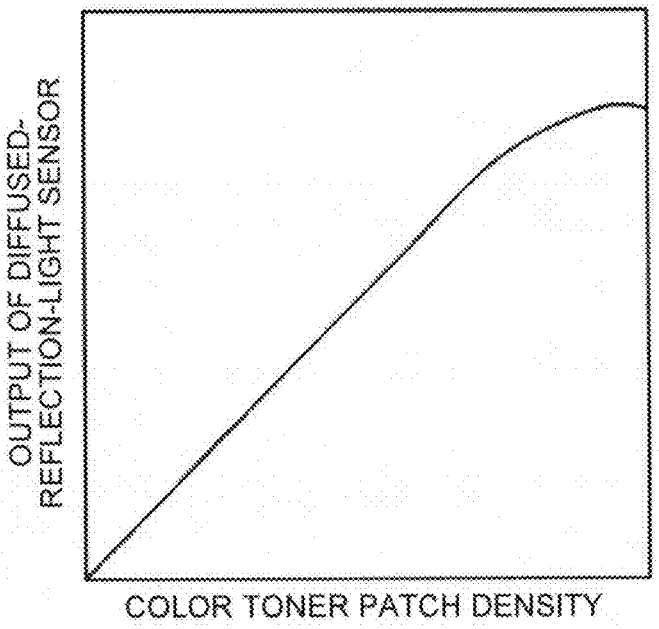
FIG. 7 is a diagram illustrating an example of outputs from a diffused-reflection-light density sensor detecting color toner.

Each of the sensors 40 includes a light-emitting element 40B-1, a regular-reflection-light sensor 40B-2, and a diffused-reflection-light sensor 40B-3 as illustrated in FIG. 5, for example. Light emitted from the light-emitting element 40B-1 is reflected by the intermediate transfer belt 12. The regular-reflection-light sensor 40B-2 detects regular reflection light of the reflected light. The diffused-reflection-light sensor 40B-3 detects diffused reflection light of the reflected light. FIG. 6 is a diagram illustrating an example of black toner patch densities versus outputs from the regular reflection sensor. As illustrated in FIG. 6, when patches are formed with black toner, the amount of regular reflection light from the patches decreases as an amount of the toner increases; accordingly, density control is to be performed using the regular-reflection-light sensor 40B-2. FIG. 7 illustrates an example of color toner patch densities versus outputs from the diffusion-reflection-light sensor. When patches are formed with color toner, the amount of diffused reflection light from the patches increases as an amount of the color toner increases; accordingly, density control is to be performed using the diffused-reflection-light sensor 40B-3.

Figure 8:
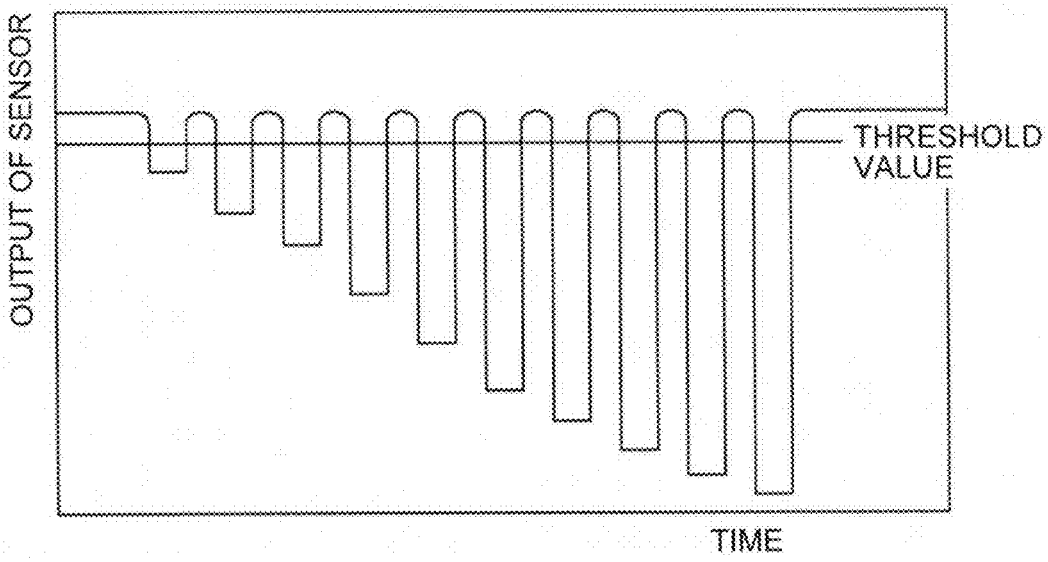
FIG. 8 is a diagram illustrating an example of outputs from one of the sensors detecting a plurality of toner patches.

FIG. 8 illustrates an example of sensor outputs from one of the sensors detecting the plurality of (ten) toner patches formed with black toner, for example. As the intermediate transfer belt 12 rotates, the toner patches pass positions immediately below the sensor. The sensor output varies with time as illustrated in FIG. 8 according to the varying densities of the detected black toner patches. A threshold value, by which the patches can be separated from a portion (background portion) where no patch is formed, is set for the sensor output. A sensor output indicating a patch position or a patch density is sampled triggered by a fall in the sensor output below the threshold value. It is possible to predict time when a patch should reach the position immediately below the sensor based on a layout of relevant parts and a linear process speed using time when the patch is written to any one of the photosensitive elements 3Y, 3M, 3C, and 3Bk first as a trigger. Accordingly, a configuration in which patch reading is performed at predicted time can be employed. However, when this configuration is employed, it is necessary to use relatively large patches to take an error into account.

There can be employed another configuration in which the light-emitting element 40B-1 starts emitting light earlier by a certain period than predicted time when the patches should reach the position immediately below the sensors; data is sampled successively; and patches are determined using the threshold value described above. This configuration allows using patches smaller than those used in the configuration in which when to perform patch exposure and when to read the patches are determined based on the layout. Using smaller patches leads to reduction in toner consumption. It is also desirable to reduce detection areas to be detected by the sensors 40 for reducing the patch size. Detection areas of the sensors of the present embodiment are circular areas that are 1 mm in diameter by virtue of employment of compact light-emitting elements and light-receiving elements or provision of slits and the like. The detection areas of the sensors are desirably 2 mm or less. In the present embodiment, the toner patch is 7 mm long in the sub-scanning direction. Toner patches that are approximately 5 mm in the sub-scanning direction may be employed with the number of data sets to be sampled, accuracy in detection of patch edges, and the like taken into account. Thence, the patch is preferably 5 to 7 mm long in the sub-scanning direction.

Referring back to FIG. 2, the reflection density of each toner patch is obtained from an output of the sensor detecting the toner patch (Step S3). Data about the ten toner patches are plotted on a graph where developing biases are along its horizontal axis and reflection densities are along its vertical axis. A slope γ of linear approximation to the plotted data is calculated (Step S4 (FIG. 2)). The slope γ indicates developing capability of the developing unit of the corresponding toner. The slope γ can be adjusted by changing a toner density in a developer. It is possible to bring the slope γ near to a desired value by reducing the toner density when the slope γ is higher than the desired value; and vice versa. It is also possible to adjust a maximum density by changing the developing bias without changing the slope γ. Specifically, increasing an absolute value of the developing bias increases an amount of toner deposited on a toner patch by development, thereby increasing reflection density of a toner patch of a maximum density; and vice versa. When the developing bias is to be changed, it is necessary to change the charging bias synchronously to maintain a difference between a charge potential at a portion of the photosensitive element that is not to be developed with toner and the developing bias constant.

The apparatus according to the present embodiment is configured as follows to achieve any one of attaining an intended maximum reflection density and placing the slope γ in a predetermined range. When the value of the slope γ is within the predetermined range, the developing bias and the charging bias are changed so as to attain the intended maximum reflection density. When the slope γ goes out of the predetermined range, a control target value of the toner density is changed so as to place the slope γ in the predetermined range. Amounts by which the developing bias and the charging bias are to be changed can be determined easily from experimentally obtained values and sensor outputs (Step S5 (FIG. 2)). An amount by which the toner density is to be changed can be obtained from data about relation between the slope γ and the toner density, which can also be experimentally obtained in advance, and the detected slope γ (Step S5 (FIG. 2)). Generally, the toner density in the developing unit is detected using a toner density sensor. Toner is replenished so as to attain an intended toner density based on an output of the toner density sensor. When the value by which the toner density is to be changed is determined, setting for the toner density is changed by changing the control target value for the toner density sensor (Step S6 (FIG. 2)). Settings for the developing bias and the charging bias are also changed (Step S6 (FIG. 2)). By performing control as described above, density variations caused by a lapse of time and environmental change of the developing units 6 can be corrected.

Figure 9:
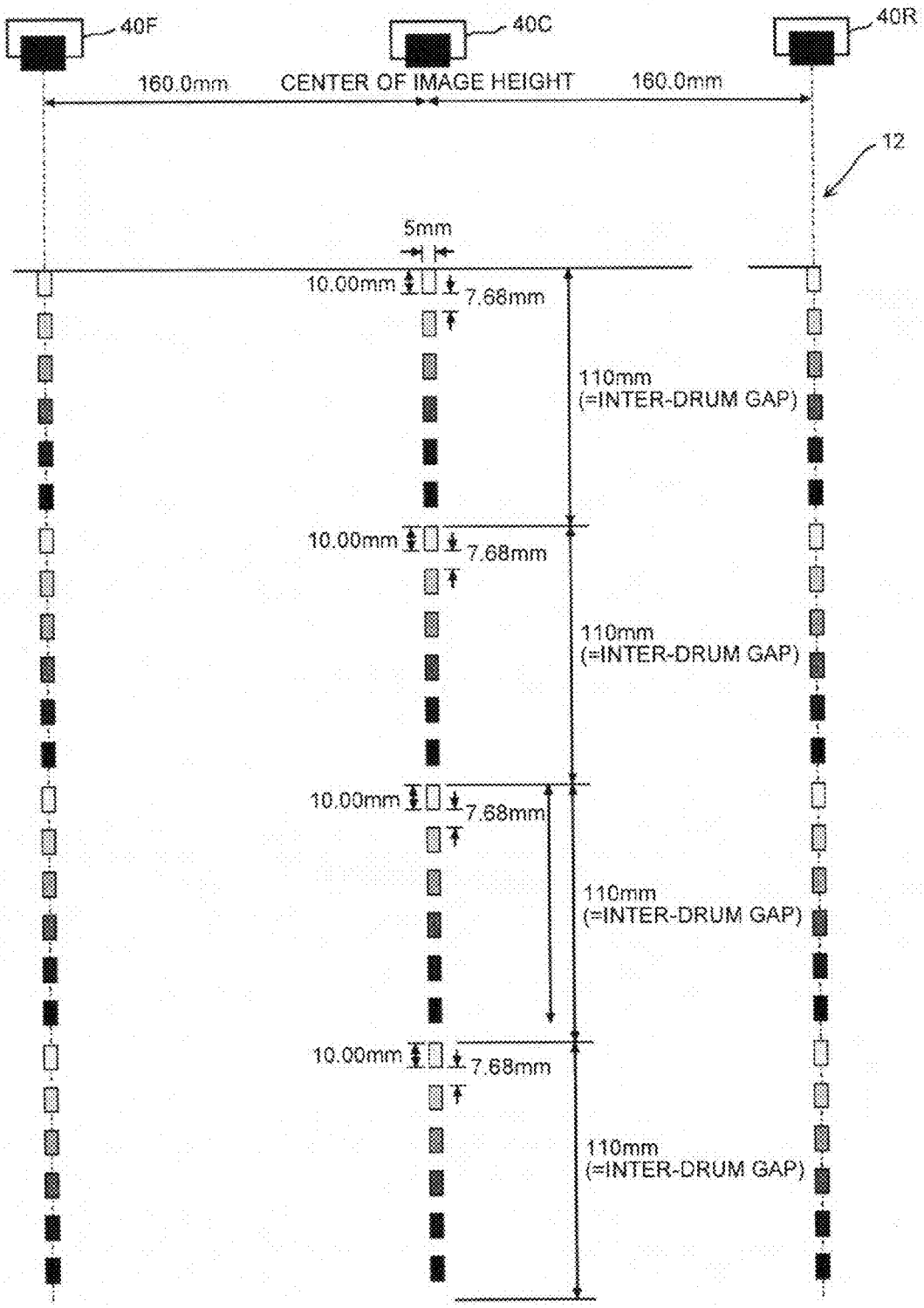
FIG. 9 is a diagram illustrating an example of toner patches formed during the non-printing period by the image forming apparatus according to the embodiment.
Figure 10:
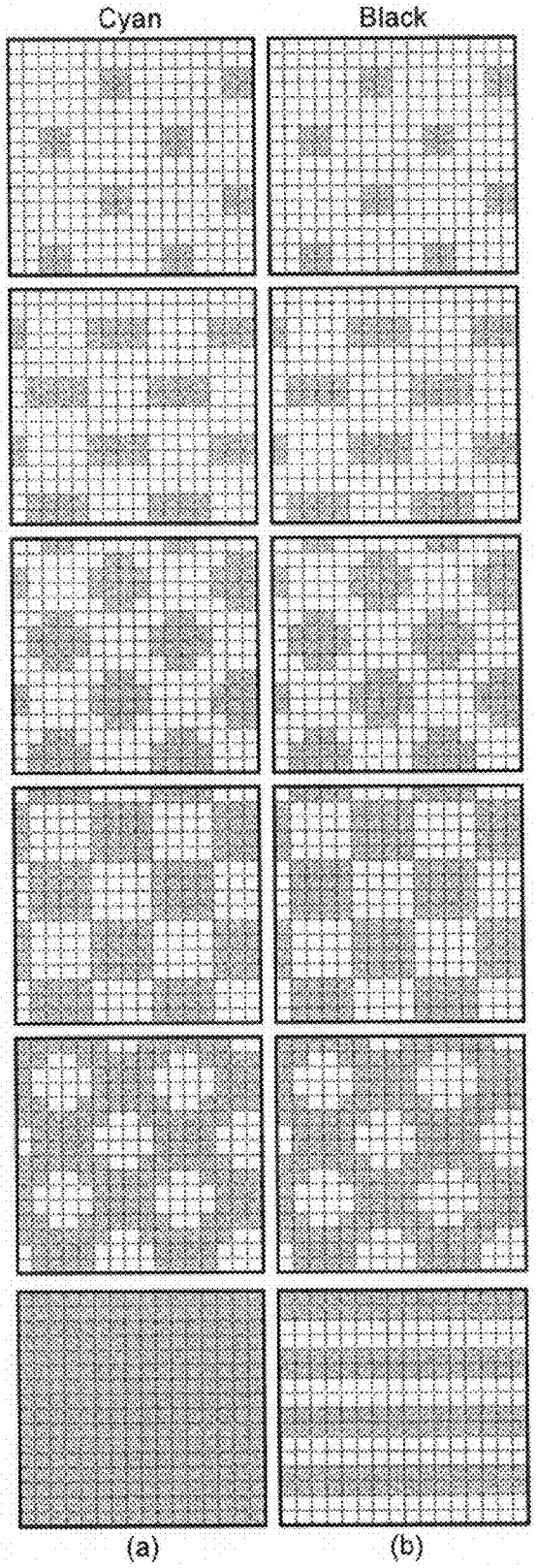
FIG. 10 illustrates example arrangements of dots in toner patches formed in varying dot area ratios during the non-printing period.

Subsequently, dot patches are formed as illustrated in FIG. 9. The dot patches are made of up dots and formed in varying dot area ratios as illustrated in FIG. 10. In the example illustrated in FIG. 9, black patches, cyan patches, magenta patches, and yellow patches are formed in series in this order from top to bottom. Digital image forming apparatuses produce a varied medium density with a varied ratio of dots per unit area, or, in other words, varied dot area ratio. It is possible to produce low, medium, and high densities by changing the dot area ratios. Meanwhile, even when dots are formed with the continuously emitted laser light described above, variations of a medium density produced with dots can occur due to variations in photosensitivity of the photosensitive element 3 or the like. To cancel out the variations of the medium density, a plurality of toner patches, which are dot patches having varying dot area ratios, are formed on the intermediate transfer belt 12 using the same charging output, the same developing bias, and the same exposure condition as those in normal image-output processing. The sensors 40 detect the toner patches (Step S7 (FIG. 2)). Employable methods for varying the dot area ratios include a method of gradually increasing the number of dots while dispersing the dots and a method of gradually increasing dots in size while gathering the dots. In the present embodiment, the latter method of increasing the dots in size is employed. This is because the latter method is more stable against noise such as jitter.

An example of dot patches, which are cyan dot patches, is illustrated in (a) of FIG. 10 as vertically-aligned dot patches on the left side. An example of dot patches, which are black dot patches, is illustrated in (b) of FIG. 10 as vertically-aligned dot patches on the right side. The size of the dots gradually increases from the top patch toward the bottom patch. Dot area ratios of the cyan dot patches, from the top patch to the bottom patch, are 12.5%, 25.0%, 37.5%, 50.0%, 62.5%, and 100%. Dot area ratios of the black dot patches, from the top patch to the bottom patch, are 12.5%, 25.0%, 37.5%, 50.0%, 62.5%, and 50%.

Output image signals are determined according to the dot patches having the varying dot area ratios. Reflection densities of the dot patches are obtained from outputs of the sensors. An approximate function is calculated from a graph where the output image signals are plotted along its horizontal axis and the reflection densities of the dot patches are plotted along its vertical axis (at Step S8 (FIG. 2)). Concurrently, a density of the black dot patch having a 50% dot area ratio and densities of yellow, magenta, and cyan dot patches, each having a 100% dot area ratio, are stored in the controller 50 (at Step S8 (FIG. 2)). It is possible to obtain an output image signal (dot area ratio) necessary for producing a reflection density required by an input signal fed from a PC or the like using the calculated approximate function (Step S9 (FIG. 2)). Thus, an output image signal necessary for producing a density required by an input image signal can be determined from the input signal (Step S9 (FIG. 2)).

Finally, the controller 50 determines a target density value for printing-period control to be performed while an image is output (Step S10 (FIG. 2)). The printing-period control is described later. A toner-patch target density value X for use in the printing-period control is determined as follows.

Toner patches for use in the printing-period control are included in the toner patches, which are referred to at Step S7, having the varying dot area ratios illustrated in FIG. 10 and formed with the toner density, the developing bias, and the charging bias that are set at Step S6. The target density value X is a mean value of densities of the dot patches in the end areas detected during the non-printing period of the toner patches. The densities of the dot patches in the end areas detected during the non-printing period are densities of the black toner patch having a 50% dot area ratio and the color toner patches having a 100% dot area ratio. The densities are detected by the sensor 40F and the sensor 40R illustrated in FIG. 9 and stored at Step S8 (FIG. 2). The target density value X may be determined by linear approximation of outputs of the sensors detecting a plurality of dot patches that vary in dot area ratio as an alternative to the method of calculating the mean value.

Figure 11:
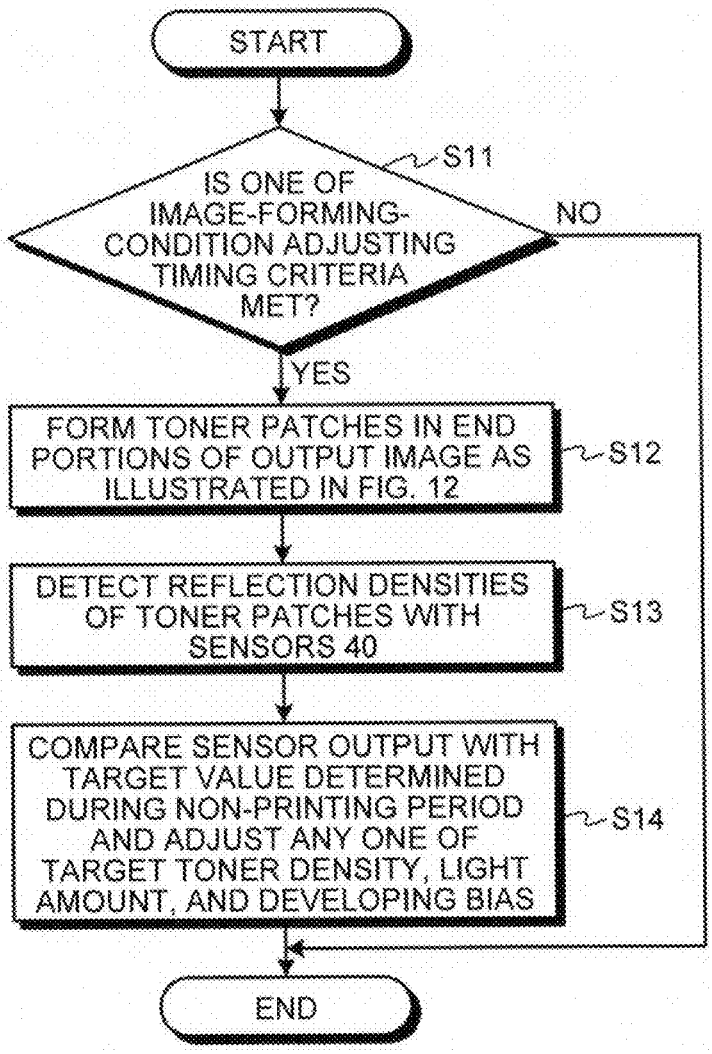
FIG. 11 is a flowchart illustrating an example control to be performed during a printing period in the image forming apparatus according to the embodiment.

Density control to be performed during the printing period (printing-period control) is described with reference to FIGS. 11 and 12.

The printing period denotes a period in which the image forming apparatus 1 is performing image-output processing. Detection of toner patches during the printing period may be performed constantly; however, densities of the toner patches rarely fluctuate greatly in the printing period. Meanwhile, it is desired to reduce toner consumption. Thence, it is preferable to perform density control by forming toner patches every predetermined number of output sheets, every predetermined period of time over which the image forming apparatus 1 performs a predetermined operation, or every predetermined cumulative number of rotations made by the photosensitive element 3 or the developing roller 5, each of which is experimentally determined. In the printing-period control, the controller 50 determines whether one of such image-forming-condition adjusting timing criteria is met first (Step S11 (FIG. 11)).

Figure 12:
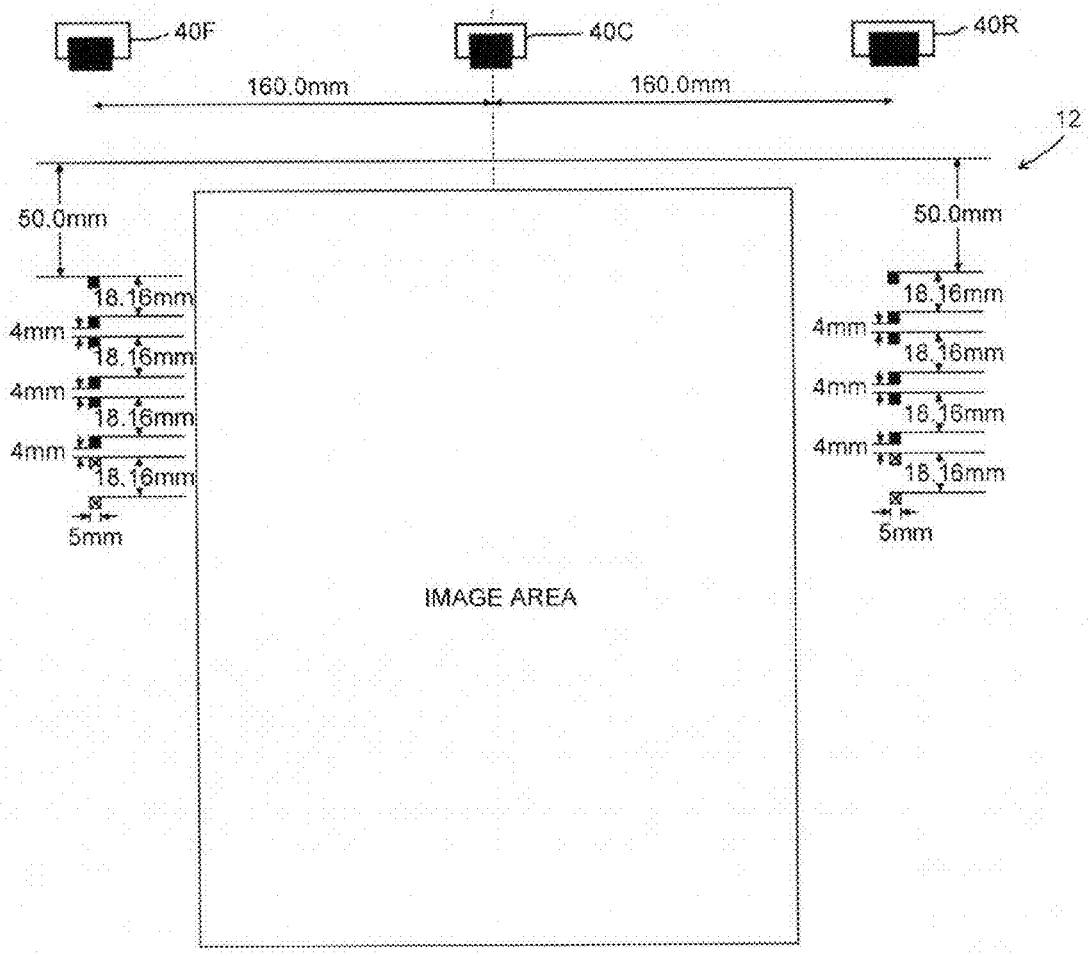
FIG. 12 is a diagram illustrating an example of toner patches formed during the printing period by the image forming apparatus according to the embodiment.

When the controller 50 determines that one of the image-forming-condition adjusting timing criteria is met (Yes), the controller 50 causes not only an output image to be written to an image area but also end-portion toner patches to be formed in non-image areas in end portions in the main-scanning direction of the intermediate transfer belt 12 as illustrated in FIG. 12 (Step S12 (FIG. 11)). The end-portion toner patches, which are fewer than the patches to be formed in the non-printing-period control, are selected in advance from the patches formed in the non-printing-period control. These patches are the same as the patches from which the target density value X is calculated according to the flowchart illustrated in FIG. 2 for the non-printing-period control. Using the same patches allows a condition of the image forming apparatus 1 immediately after the non-printing-period control, by which the developing bias and the like are adjusted, to be maintained more easily than using different patches.

Figure 13:
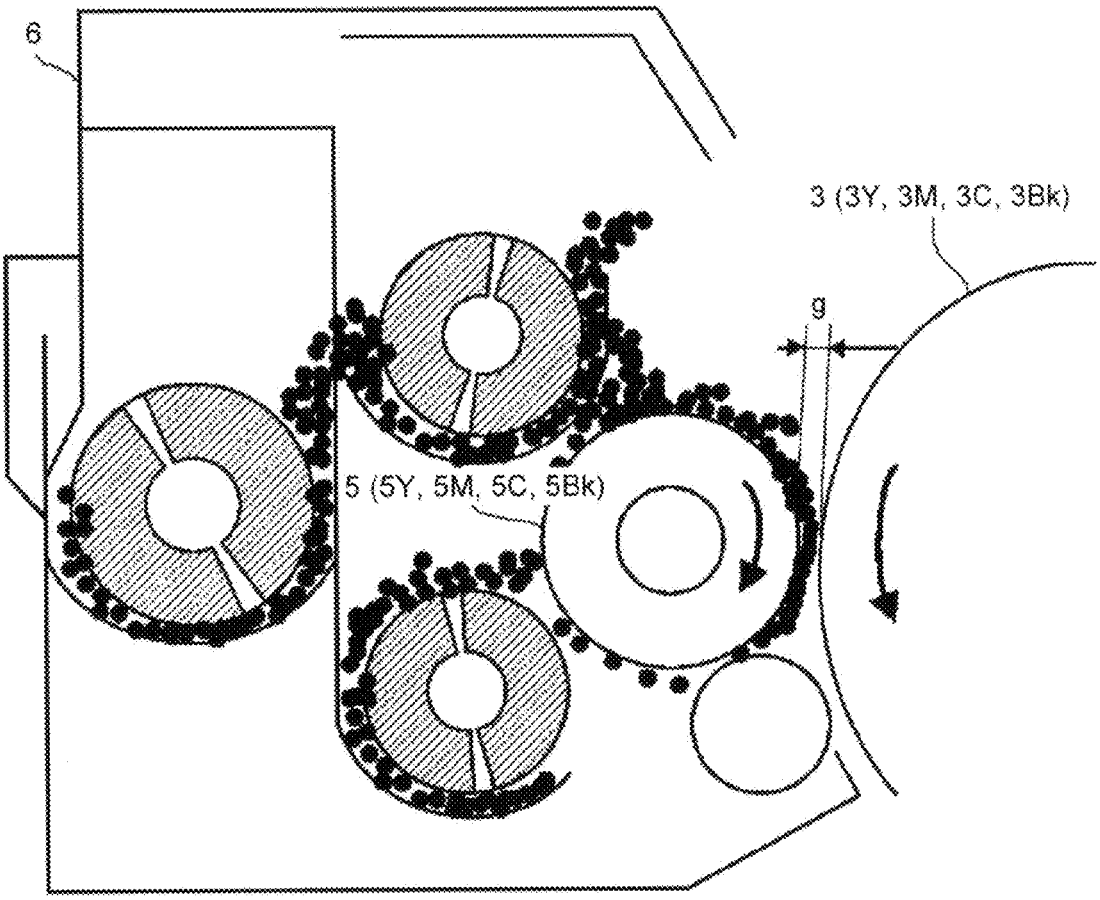
FIG. 13 is a cross-sectional configuration diagram of a developing unit of the image forming apparatus according to the embodiment.
Figure 14:
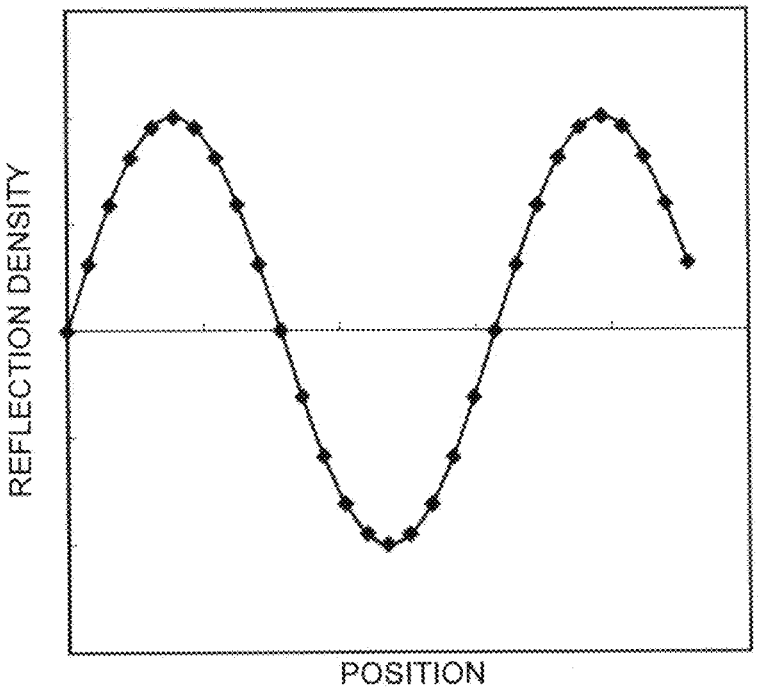
FIG. 14 is a graph illustrating an example of density variations resulting from run-out of a developing roller.

The end-portion toner patches illustrated in FIG. 12 include two identical patches that are formed with a pitch of 18.16 mm, which is one-half circumferential length of the developing roller 5, for each color. Having such a pitch provides the following advantage. That is, there is a gap g between the developing roller 5 and the photosensitive element 3 as illustrated in FIG. 13. The gap g is varied by run-out of the developing roller 5 (5Y for yellow, 5M for magenta, 5C for cyan, and 5Bk for black). For instance, when the developing roller 5 has a rotation center at a position slightly deviated from its exact center, fluctuations of the gap occur. The gap fluctuations result in such density variations as those illustrated in FIG. 14. FIG. 14 illustrates an example of reflection density variations of a toner patch formed by applying a uniform developing bias to a patch having a uniform surface potential. FIG. 14 is a graph in which differences of reflection densities with respect to a mean value are plotted along the vertical axis, and positions on the toner patch with respect to a moving direction of the photosensitive element are plotted along the horizontal axis. Reflection densities should be invariant because development is performed by applying the uniform developing bias to the surface at the uniform potential. However, the fluctuations of the developing gap g cause the reflection densities to vary as illustrated in FIG. 14. Performing density control using the fewer toner patches in a condition where such density variations occur can adversely result in unstable density control. This can be prevented by manufacturing the developing roller 5 highly accurately. However, the need of manufacturing the developing roller 5 highly accurately can be eliminated; that is, the density variations can be cancelled out when the toner patches are formed with the pitch of the one-half circumferential length of the developing roller as in the present embodiment.

Figure 15:
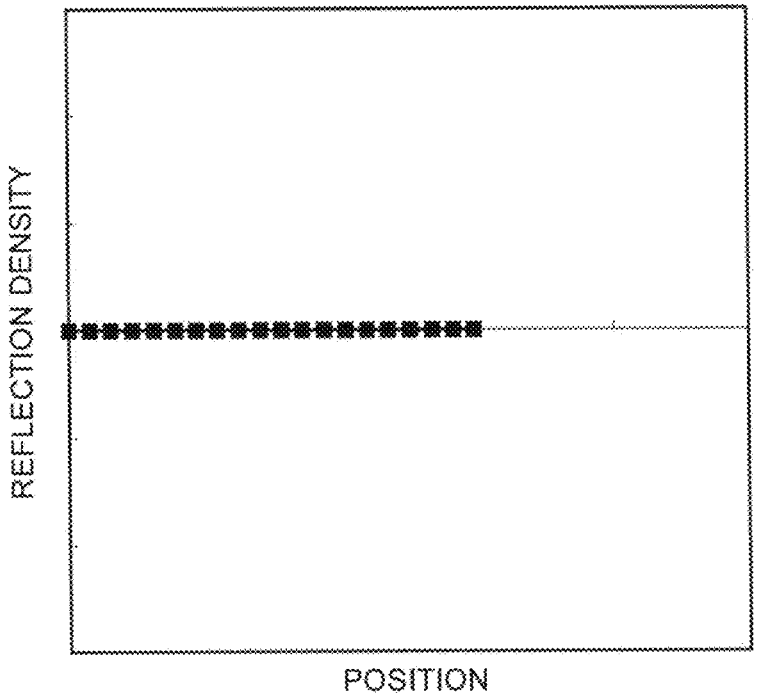
FIG. 15 is a graph illustrating mean values of densities of two patches spaced from each other one-half circumferential length of the developing roller where the density variations illustrated in FIG. 14 occur.

FIG. 15 is a graph illustrating mean values of densities at two points (that are the two patches illustrated in FIG. 12 of each color) spaced from each other one-half of a cycle on a sine curve representing the density variations illustrated in FIG. 14. FIG. 15 indicates that the density variations are cancelled out. Thus, it is possible to cancel out density variations caused by run-out of the developing roller 5 and stabilize density control by forming identical toner patches spaced from each other the one-half circumference length of the developing roller and calculating mean values of the densities of the toner patches. For a similar reason, identical toner patches for use in the printing-period control, which are some of the toner patches having the varying dot area ratios and formed at Step S7 in FIG. 2, may be formed with the gap of the one-half circumference length of the developing roller for each color, so that a mean density of the identical toner patches is used as the target value.

The lowermost black patch among the end-portion toner patches illustrated in FIG. 12 is a medium-density patch having a 50% dot area ratio. The reason why such a patch is used is because, as indicated in FIG. 6 where output characteristics of the regular reflection sensor are illustrated, a sensor output changes by a smaller amount to a change in density or, in other words, the sensor exhibits poorer sensitivity in an area where the toner patch density (reflection density) is high. Accordingly, it is desirable for the printing-period control to use a toner patch density within an area A in FIG. 6 of medium densities where a sensor output changes relatively sensitively to a change in toner patch density. The area A is a range where dot area ratio is approximately 70% or lower. Furthermore, the higher the patch density, the better; this is because importance is placed on ensuring a maximum density. Accordingly, a lower limit of the patch density is set to 30%.

Figure 16:
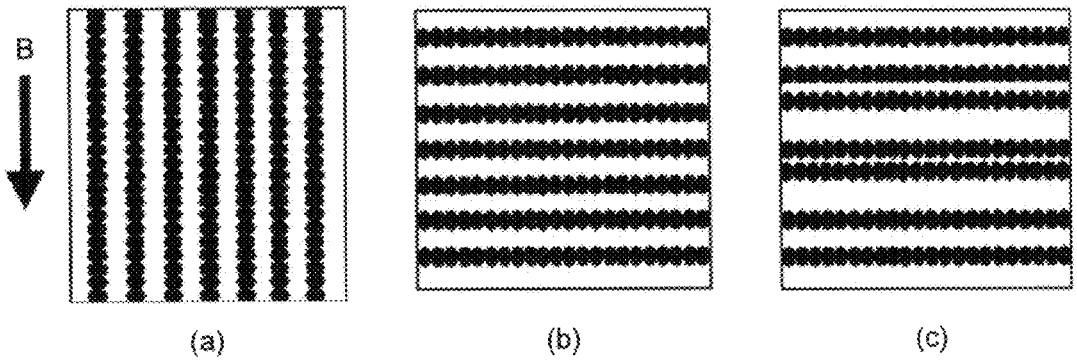
FIG. 16 illustrates example arrangements of dots that form a medium-density black patch.

Furthermore, it is desirable that the medium-density black dot patches illustrated in FIG. 12 are formed as in FIG. 16A where the dots are arranged to form straight lines along a sub-scanning direction B in which the intermediate transfer belt 12 rotates. This is because when lines of the dots are arranged in the main-scanning direction as in FIG. 16B, dot positions can change to such arrangement illustrated in FIG. 16C due to fluctuations in linear velocity of the transfer belt, which makes patch densities unstable. The arrangement of the dot patches can be created easily by storing patch image data in the controller 50 in advance.

Referring back to FIG. 11, the sensor 40F and the sensor 40R detect reflection densities of the formed toner patches that pass therebelow (Step S13 (FIG. 11)). At this time, data is sampled using substantially the same method as that used in reading the toner patches formed with the continuously emitted laser light. Specifically, time when a patch should reach the position immediately below the sensor can be calculated based on time when the patch is written, the layout, and the linear process speed. The light-emitting element 40B-1 is caused to start emitting light a short time earlier than the calculated time; a sensor output indicating a patch position or a patch density is sampled triggered by a fall in the sensor output below a preset threshold value.

In the present embodiment, a mean value of densities of two identical dot patches is calculated as illustrated in FIG. 12. A reflection density obtained from a sensor output is compared with the target density value X determined in the non-printing period control, and any one of a target toner density, light amount, and the developing bias is adjusted (Step S14 (FIG. 11)). When the reflection density is lower than the target density value X, any one of increasing the control target value of the toner density and increasing an absolute value of the developing bias is performed; and vice versa. An amount to be changed can be experimentally determined for each image forming apparatus. The amount of write light can be increased or decreased more quickly than the toner density. Accordingly, in the apparatus according to the present embodiment, what is adjusted is the light amount.

As described above, in the present embodiment, a plurality of toner patches are formed to adjust the image forming condition with high accuracy during the non-printing period; during the printing period, end-portion toner patches that are fewer than the toner patches of the non-printing period control are formed and detected in parallel with an output image, and density control is performed while maintaining the same condition as that in the non-printing period. Accordingly, a condition where images are stable can be maintained longer when compared to a configuration in which only non-printing-period density control is performed. Furthermore, density control is performed more finely when compared to a configuration in which only printing-period density control is performed.

Although FIG. 12 illustrates an example where the end-portion toner patches are formed in addition to an output image, the end-portion toner patches are not necessarily formed when the sheet S is large in size. The intermediate transfer belt 12 is required to have a width larger than a width of maximum-size paper to allow forming the end-portion toner patches in the non-image areas in parallel with forming an output image in the image area even when the maximum-size paper is used. Increasing the width of the intermediate transfer belt 12 leads to upsizing of the image forming apparatus 1. Meanwhile, maximum-size paper is rarely used by users. Accordingly, there can preferably be employed a configuration in which the printing-period control is performed when paper of smaller size is used but not performed when maximum-size paper is used.

When the apparatus of the present embodiment adopts the configuration in which the printing-period control is performed even when maximum-size paper is used, the secondary transfer roller 18 desirably has a width that is appropriate for the width of the maximum-size paper and prevents contact between the end-portion toner patches on the intermediate transfer belt 12 and the secondary transfer roller 18. When the secondary transfer roller 18 has such a width, contact between the end-portion toner patches and the secondary transfer roller 18 does not occur. Accordingly, it is unnecessary to move the secondary transfer roller 18 away from the intermediate transfer belt 12. In the non-printing-period control, the secondary transfer roller 18 is moved away from the intermediate transfer belt 12 by a mechanism (not shown) that moves the secondary transfer roller 18 toward and away from the intermediate transfer belt 12 to prevent the secondary transfer roller 18 from contacting the toner patches.

There can be a case where a user desires to use the sheet S that is large enough to overlap an area where the end-portion toner patches are to be formed in the image forming apparatus 1 that includes the secondary transfer roller 18 whose width is smaller than the width of the intermediate transfer belt 12 to prevent the secondary transfer roller 18 from contacting with the end-portion toner patches. In such a case, the user can use the sheet of large size by changing the secondary transfer roller 18 to wider one. However, in this case, it should be noted that it is necessary to disable forming toner patches in the printing-period control to prevent contamination of the secondary transfer roller 18.

Figure 17:
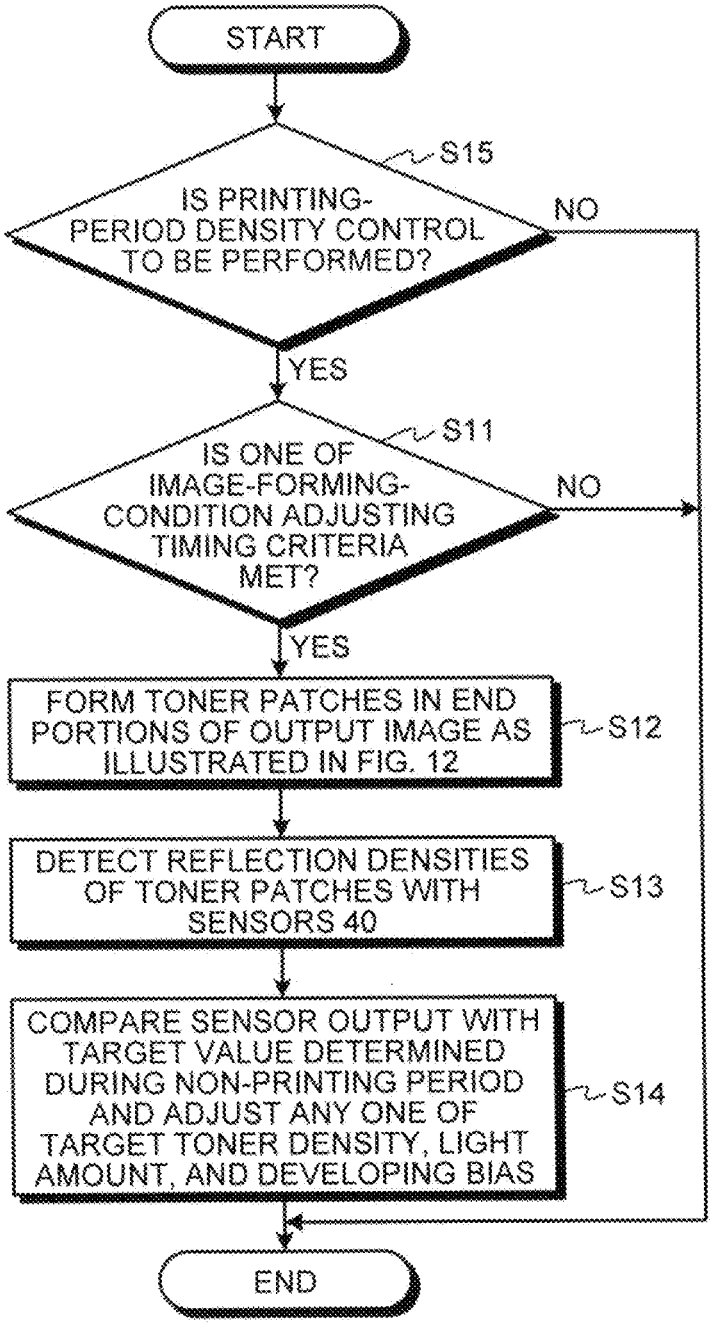
FIG. 17 is a diagram illustrating an example flowchart for program instructions, which are to be executed by a controller, configured to be capable of disabling the printing-period control.

FIG. 17 is a flowchart for program instructions, which are to be executed by the controller 50, configured to disable the printing-period control when switchover of a sheet size to, specifically, paper of maximum size, is made. As illustrated in FIG. 17, the controller 50 determines whether the printing-period density control is to be performed or not first (Step S15). Setting as to whether to perform the printing-period control or not may be configured by a user from an operation panel of the image forming apparatus 1 or contained in driver program for the image forming apparatus 1 installed on the PC or the like. When the printing-period density control is to be performed, as in the procedure of the flowchart illustrated in FIG. 11, the controller 50 determines whether any one of the image-forming-condition adjusting timing criteria is met (Step S11), forms the end-portion toner patches (Step S12), detects reflection densities (Step S13), and adjusts any one of a target toner density, light amount, and the developing bias (Step S14). When the printed-period density control is not to be performed, the printed-period density control is terminated.

In the embodiment described above, the intermediate transfer belt is used as the image carrier. However, an apparatus to which the control according to the embodiment is applicable is not limited to an image forming apparatus that uses an intermediate transfer belt. For instance, the intermediate transfer belt may be an intermediate transfer drum. The embodiment is applicable to an image forming apparatus that uses a direct transfer belt onto which paper is conveyed and via which a toner image is transferred from a photosensitive element onto the paper. The embodiment can be implemented in a configuration in which toner patches on a photosensitive element are detected. When this configuration is employed, the photosensitive element serves as the "image carrier", the photosensitive element is omitted from the "toner-image forming device", and the "toner-image forming device" is a device for forming a toner image on the photosensitive element.

According to an aspect of the embodiments, it is possible to perform highly-accurate density correction and the like by forming sufficient toner patches during a non-printing period, such as at power-on or after a predetermined number of output images are formed, and to maintain, during an image output period, an image-forming condition determined during the non-printing period by forming fewer toner patches. Accordingly, there can be obtained an image forming apparatus that requires less frequent toner patch formation and has reduced variations in image density and less color misregistration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier;

a toner-image forming device configured to form a toner image on the image carrier;

a controller configured to control the toner-image forming device to form a toner patch;

a detector configured to detect the toner patch on the image carrier; and a developing unit including a developing roller, wherein during a non-printing period, the controller causes the toner-image forming device to form a plurality of toner patches, causes the detector to detect densities of the plurality of toner patches, and adjusts an image-forming condition of the toner-image forming device based on detected densities, and during a printing period, the controller causes the toner-image forming device to form an output image in an image area and form fewer toner patches in a non-image area, causes the detector to detect densities of the fewer toner patches, and adjusts the image-forming condition of the toner-image forming device based on detected densities, the fewer toner patches being selected from and fewer than the plurality of toner patches formed during the non-printing period.

2. The image forming apparatus according to claim 1, wherein the controller causes the toner-image forming device to form the fewer toner patches during the printing period with a pitch of approximately one-half circumferential length of the developing roller.

3. The image forming apparatus according to claim 1, wherein the fewer toner patches to be formed during the printing period include a medium-density black patch.

4. The image forming apparatus according to claim 3, wherein the medium-density patch is made up of dots ranging in dot area ratio from 30% to 70%.

5. The image forming apparatus according to claim 4, wherein the medium-density patch is made up of dots arranged to form lines along a direction in which the image carrier moves.

6. The image forming apparatus according to claim 1, wherein the controller determines a target density value of the toner patches to be formed during the printing period based on the detected densities obtained during the non-printing period.

7. The image forming apparatus according to claim 6, wherein the controller causes the toner-image forming device to form the plurality of toner patches in an end area on the image carrier and in a center area on the image carrier with respect to a direction perpendicular to a direction in which the image carrier moves during the non-printing period, the end area being the non-image area, the center area being an image area, the controller causes the toner-image forming device to form the fewer toner patches only in the end area on the image carrier during the printing period, and the target density value is a mean value of densities of the dot patches in the end area detected during the non-printing period.

8. The image forming apparatus according to claim 1, wherein each of the toner patches is 5 to 7 mm long in a direction in which the image carrier moves.

9. The image forming apparatus according to claim 1, wherein the toner-image forming device further includes an exposure unit, the plurality of toner patches formed during the non-printing period include a plurality of patches and a plurality of dot patches, the plurality of patches being formed with light continuously emitted from the exposure unit and by causing a developing bias applied by the developing unit to vary, the plurality of dot patches varying in dot area ratio, and the fewer toner patches to be formed during the printing period are some dot patches of the plurality of dot patches that vary in dot area ratio.

10. The image forming apparatus according to claim 1, wherein the controller causes the toner-image forming device not to form the fewer toner patches during the printing period depending on a size of a recording medium on which the output image is to be formed.

11. The image forming apparatus according to claim 1, wherein whether to disable forming the fewer toner patches during the printing period is configurable by any one of a user and a maintenance person.

* * * * *